US005613605A

United States Patent [19]

Angeles et al.

[11] Patent Number: 5,613,605

[45] Date of Patent: Mar. 25, 1997

[54] PLANT PACKAGE

[75] Inventors: James P. Angeles, Cleveland; Thomas F. Dugan, Perry; John R. Nottingham, Hunting Valley; Dale A. Panasewicz, Strongsville; Brian J. Sroub, Shaker Heights, all of Ohio

[73] Assignee: Agripak, Inc., Pepper Pike, Ohio

[21] Appl. No.: 303,656

[22] Filed: Sep. 19, 1994

Related U.S. Application Data

[63] Continuation of Ser. No. 87,153, Jul. 2, 1993, abandoned, which is a continuation-in-part of Ser. No. 850,625, Mar. 13, 1992, Pat. No. 5,224,598.

[51] Int. Cl.[6] ..... B65D 85/52

[52] U.S. Cl. ..... 206/423; 47/84; 206/461

[58] Field of Search ..... 47/66, 72, 84; 53/397; 206/205, 423, 461

[56] References Cited

U.S. PATENT DOCUMENTS

| | | | |
|---|---|---|---|
| 1,669,617 | 5/1928 | Kennedy | 206/423 |
| 1,909,013 | 5/1933 | Ruzicka . | |
| 1,988,886 | 1/1935 | Wilson . | |
| 2,446,509 | 8/1948 | Fischer . | |
| 2,649,807 | 8/1953 | Ritter . | |
| 2,664,670 | 1/1954 | Mulford | 47/72 |
| 2,736,138 | 2/1956 | Buttery | 206/423 |
| 2,739,422 | 3/1956 | Perkins . | |
| 2,774,187 | 12/1956 | Smithers | 206/423 |
| 2,994,424 | 8/1961 | Selby et al. . | |
| 3,094,810 | 6/1963 | Kalpin . | |
| 3,205,077 | 9/1965 | Hammond . | |
| 3,225,805 | 12/1965 | Wise | 206/423 |
| 3,266,188 | 8/1966 | Budd . | |
| 3,302,325 | 2/1967 | Ferrand . | |
| 3,314,194 | 4/1967 | Halleck | 47/84 |
| 3,462,061 | 8/1969 | Shore . | |
| 3,640,381 | 2/1972 | Kanada et al. . | |
| 3,704,545 | 12/1972 | van Reisen | 206/423 |
| 3,738,956 | 6/1973 | Glatti et al. . | |
| 3,748,781 | 7/1973 | Erling | 206/423 |
| 3,857,934 | 12/1974 | Bernstein et al. . | |
| 3,869,828 | 3/1975 | Matsumoto . | |
| 3,874,115 | 4/1975 | London et al. . | |
| 3,962,823 | 6/1976 | Zipperer, III . | |
| 3,973,356 | 8/1976 | Schacht . | |
| 3,995,396 | 12/1976 | Spector . | |
| 4,006,561 | 2/1977 | Thoma et al. . | |
| 4,014,134 | 3/1977 | Womack, Jr. . | |
| 4,014,139 | 3/1977 | Shooter et al. . | |
| 4,019,279 | 4/1977 | Moorman et al. . | |
| 4,075,786 | 2/1978 | van Zyl | 206/423 |
| 4,079,547 | 3/1978 | Walker . | |
| 4,113,093 | 9/1978 | Hendrickx | 47/84 |
| 4,118,890 | 10/1978 | Shore . | |
| 4,136,502 | 1/1979 | Shore . | |
| 4,189,868 | 2/1980 | Tymchuck et al. . | |
| 4,242,835 | 1/1981 | Sorribes . | |
| 4,248,347 | 2/1981 | Trimbee . | |
| 4,265,049 | 5/1981 | Gorewitz . | |
| 4,292,761 | 10/1981 | Krave . | |
| 4,411,921 | 10/1983 | Woodruff . | |
| 4,413,725 | 11/1983 | Bruno et al. . | |
| 4,423,080 | 12/1983 | Bedrosian . | |
| 4,554,761 | 11/1985 | Tell . | |

(List continued on next page.)

FOREIGN PATENT DOCUMENTS

| | | |
|---|---|---|
| 2220340 | 1/1990 | United Kingdom . |
| 9420389 | 9/1994 | WIPO . |

*Primary Examiner*—Jimmy G. Foster
*Attorney, Agent, or Firm*—Calfee, Halter & Griswold

[57] ABSTRACT

A plant package for a live plant having a stem, roots and rooting medium surrounding the roots. The package comprises a self-supporting, light transmissive, sealed polymer shell having an internal surface defining a package interior. A shelf is provided on the internal surface, and defines first and second interior compartments for containing the roots and stem, respectively. An inner container is provided for the roots and rooting medium, and an outer container engaged with the internal surface is provided for the inner container. A divider is engaged with the stem and inner container and assists with the maintenance of the roots and rooting medium within the inner container.

28 Claims, 8 Drawing Sheets

U.S. PATENT DOCUMENTS 4,603,077 7/1986 Fujimoto et al. .
4,621,733 11/1986 Harris .
4,735,308 4/1988 Barner .
4,741,440 5/1988 Harris .
4,903,431 2/1990 Stoll .
4,908,315 3/1990 Kertz .
4,910,032 3/1990 Antoon, Jr. .
4,923,703 5/1990 Antoon, Jr. .
4,936,046 6/1990 Miller .
5,001,860 3/1991 Rudnick .
5,029,708 7/1991 Alonso .
5,171,390 12/1992 Travers ..... 47/72
5,224,598 7/1993 Angeles et al. ..... 206/423

PLANT PACKAGE

This is a continuation of application(s) Ser. No. 08/087,153 filed on Jul. 2, 1993, abandoned, which is a continuation-in-part of application(s) Ser. No. 7/850,625 filed on Mar. 13, 1992, U.S. Pat. No. 5,224,598.

TECHNICAL FIELD

The present invention relates to a package for live plants, and more particularly to a low maintenance, sealed plant package for shipment, storage, display, sale, and transportation by consumers of the live plants.

BACKGROUND OF THE INVENTION

Most live plants are fragile and require special attention for shipment, storage, display and sale. In order to survive, live plants must be given proper care, including proper lighting, watering and protection from insects, fungus and bacteria. However, during display of the plant prior to sale, it must also be readily visible to the potential consumer, while at the same time be protected from handling by the consumer. This combination of requirements has made live plants a difficult consumer product to package and market for purposes of sale through conventional self-service retail sales channels, such as gift, department and grocery stores. The plant package shown in U.S. Pat. No. 4,118,890 provided solutions to many of the packaging problems faced by prior live plant distributors. However, it was believed that a package which was even more efficient to manufacture, provided more selection in the size and shape of the plants contained therein was required.

SUMMARY OF THE INVENTION

The present invention provides an improved plant package for use in the sale of live plants in self-service retail sales stores, as well as other sales methods such as mail order, and which enables the successful shipment, storage and sale of healthy live plants. This improved, simple to manufacture plant package protects live plants from external damage such as shipping, insects, fungus, bacteria and consumer handling, and at the same time provides the plant with the necessary water, nutrition and better light distribution for successful storage and display prior to consumer sale.

The plant package of the present invention includes a self-supporting, light transmissive, sealed shell formed by first and second elements which together form an internal surface defining a package interior. The sealed shell includes a shelf formed on the internal surface which defines two interior compartments within the shell for containing: i) the roots and rooting medium of the plant, and ii) the stem or stems and foliage. Inner and outer containers are provided for supporting the roots and rooting medium of the plant within the shell. The inner container maintains the roots and rooting medium, and the outer container supports the inner container within the interior root compartment of the shell.

A divider which comprises strips of paper material is positioned within the shell such that the strips surround the stem or stems and cover the rooting medium and the containers. The divider assists with maintenance of the roots and rooting medium within the inner container. A band is provided which helps to hold the divider within the containers.

The shell of the plant package may be formed of separate pieces, or as a single unit having the elements hinged together. The wall portion of the shell defining the root compartment has a thickness which allows better support and handling of the overall plant package, and supports the containers. The wall portion of the shell defining the foliage compartment is thinner than that of the root compartment. Additionally, the wall portion of the shell foliage includes a spherical portion. The spherical portion and the center of the wall portion are thicker, such that the thicker spherical portion provides better light distribution to the plant, and the center portion assists with better handling of the package.

A seal is provided between the pieces or elements of the shell. By providing a sealed shell having a divider forming the compartments described, the foliage and root of the live plant are maintained in their respective environments which contain the necessary moisture to eliminate regular watering requirements, and protect the plant from insects, fungus, bacteria, viruses and other foreign matter, as well as improper handling.

Other features and advantages of the present invention will become apparent from the following detailed description of the preferred embodiments made with reference to the accompanying drawings.

DETAILED DESCRIPTION

Figure 1:
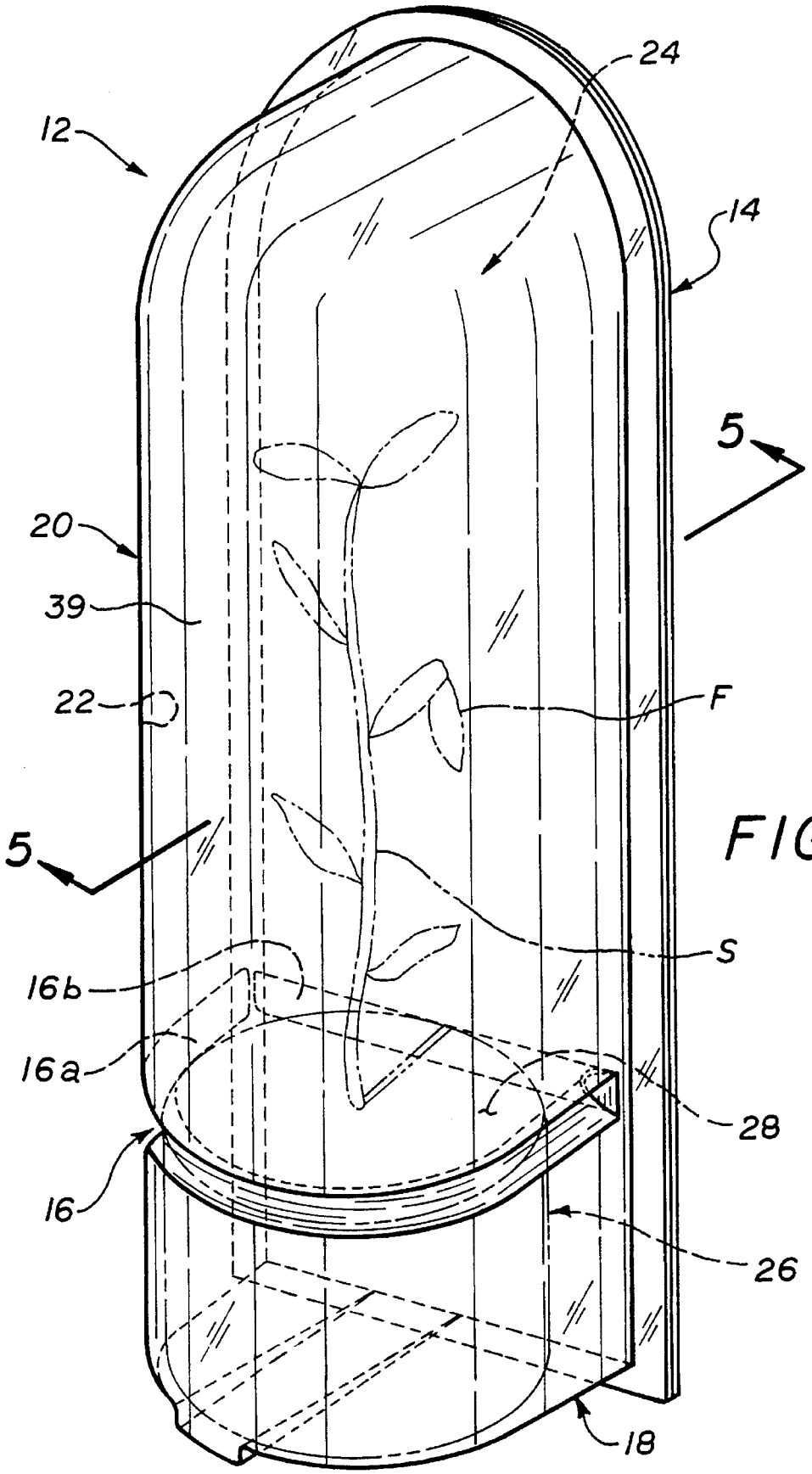
FIG. 1 is a perspective view of a plant package constructed in accordance with the present invention, containing a live plant shown in phantom.

A plant package, indicated generally at reference numeral 12, constructed in accordance with the present invention is illustrated in FIG. 1. The package 12 comprises a shell 14 having a shelf 16 defining a first root interior compartment 18 for containing the roots R and rooting medium D surrounding the roots of a live plant, and a second foliage interior compartment 20 for containing the plant stem S and foliage F. The shell 14 includes an internal surface 22 defining an interior package compartment 24 of the plant package 12. A container 26 for the roots and rooting medium R, D and a divider 28 are also provided.

Figure 2A:
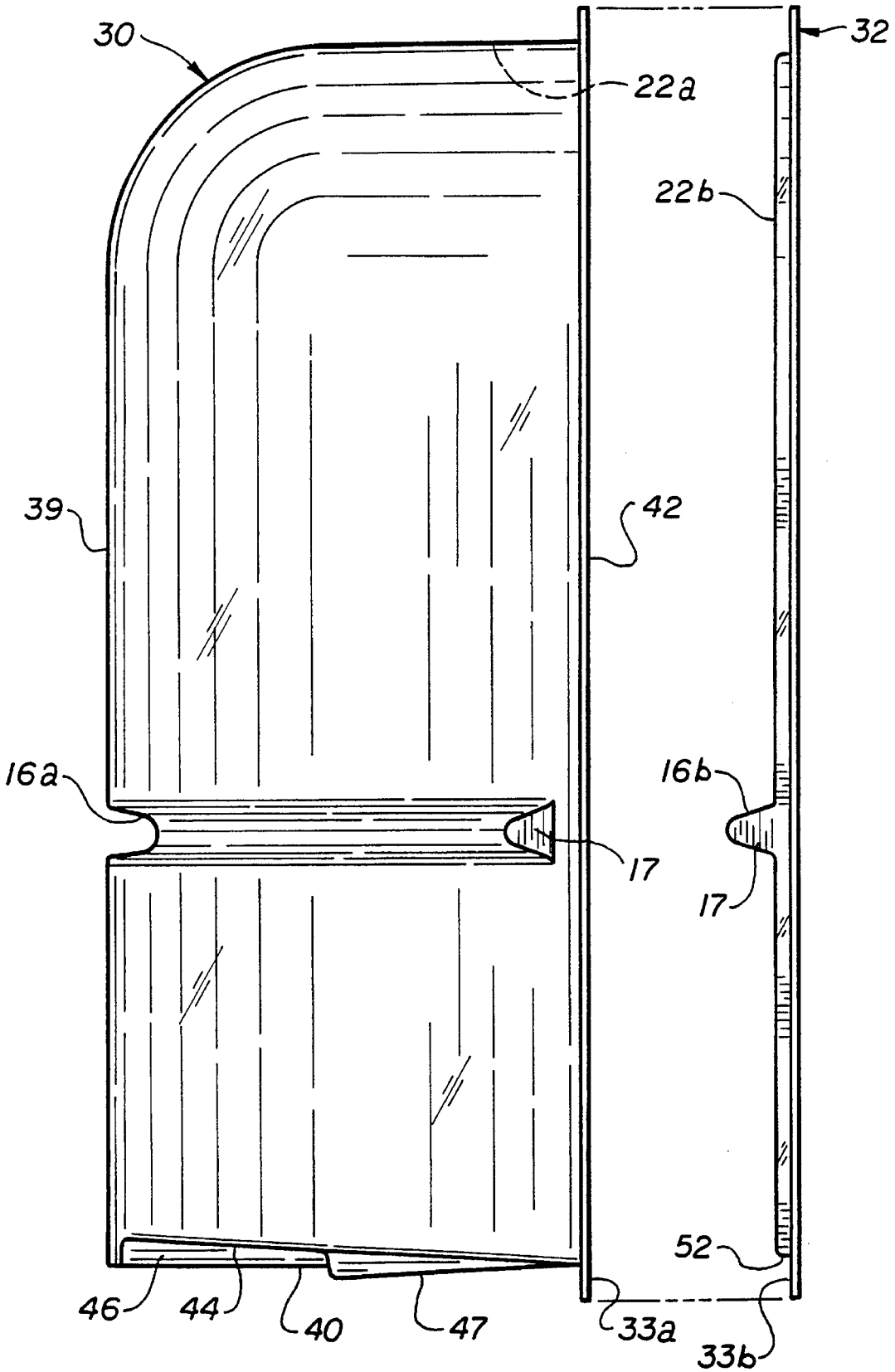
FIG. 2A is a side view of a shell of the plant package of FIG. 1.
Figure 2B:
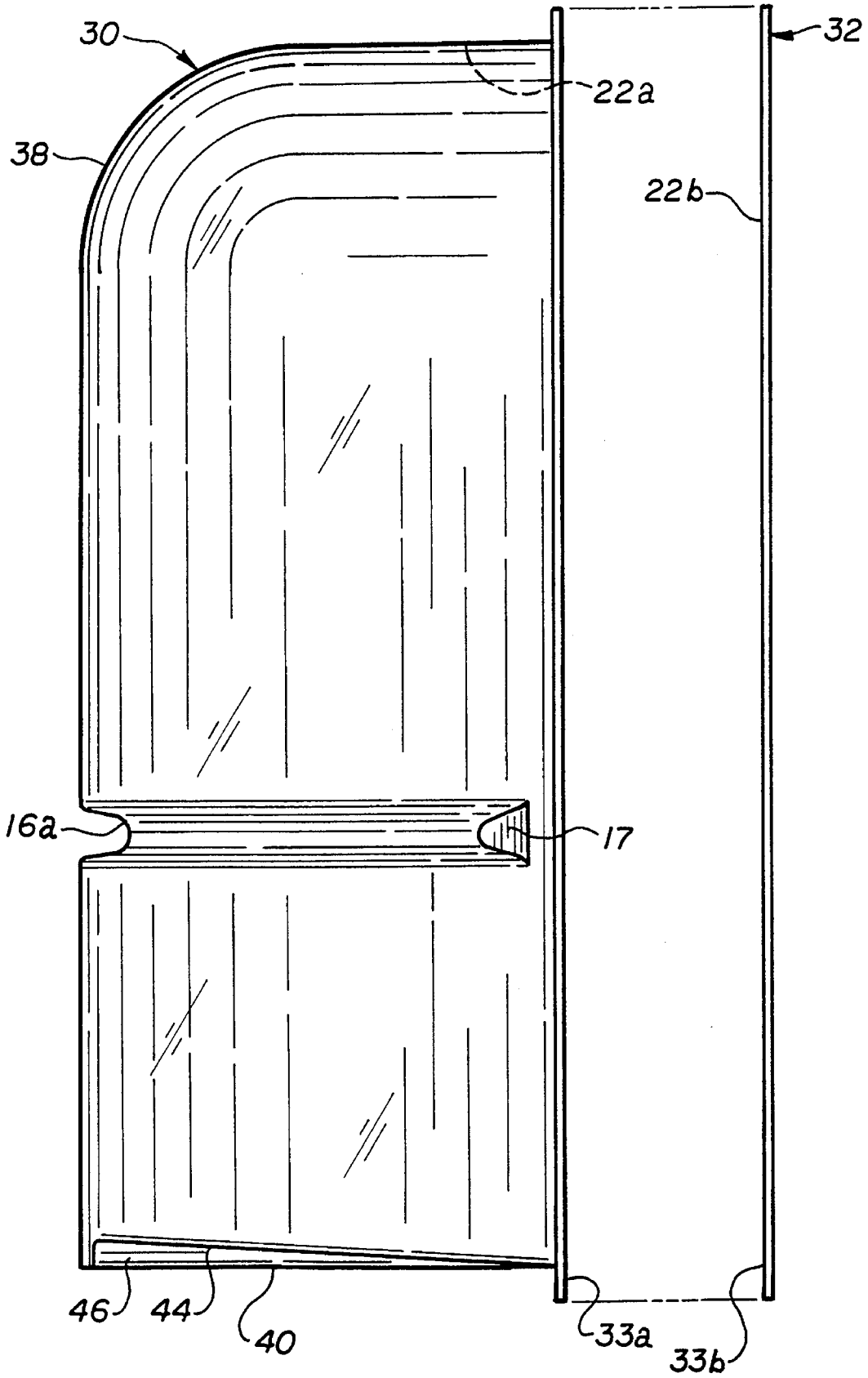
FIG. 2B is a side view of an alternate embodiment of a shell of a plant package constructed in accordance with the present invention.
Figure 3:
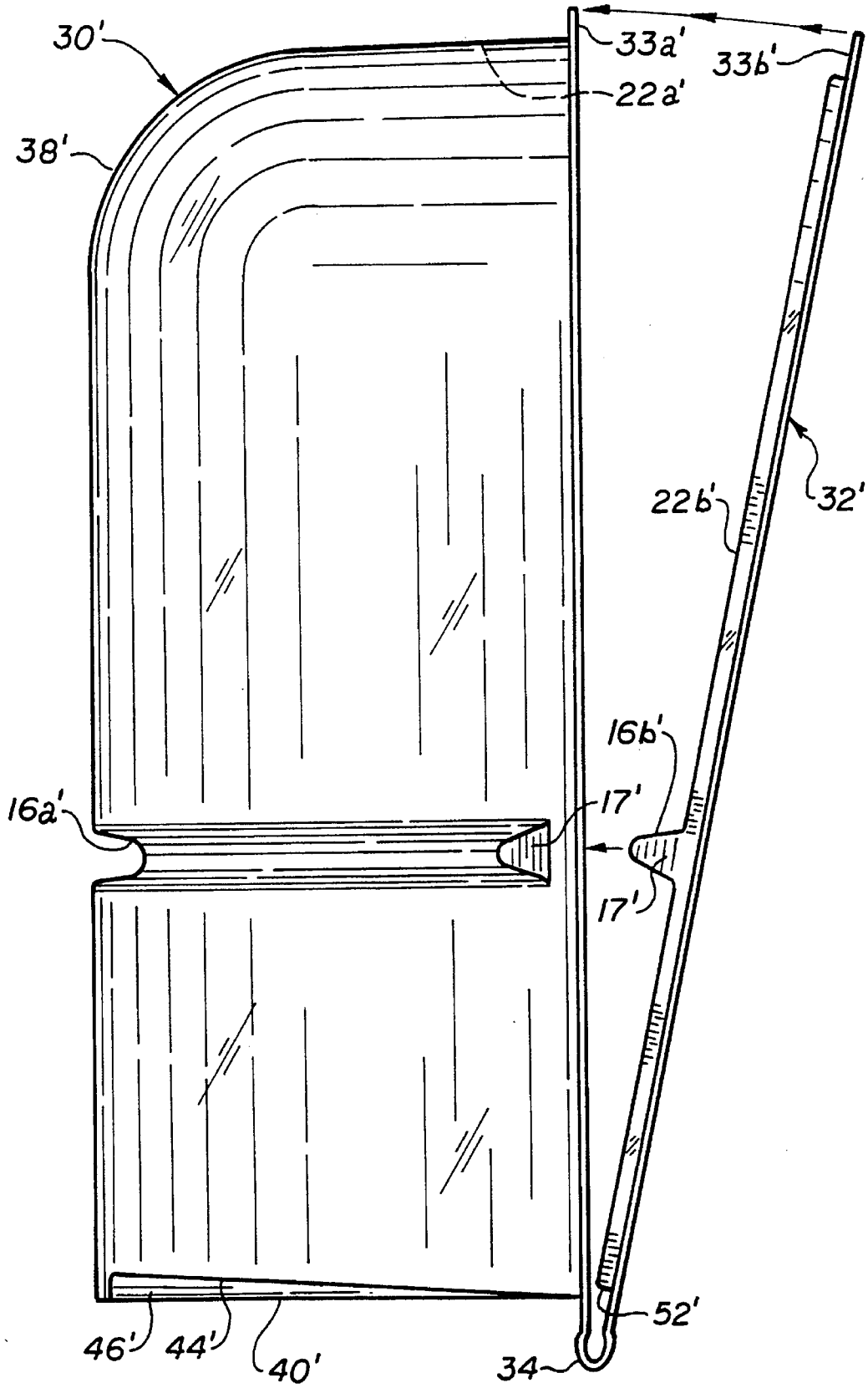
FIG. 3 is a side view of another alternate embodiment of a shell of a plant package constructed in accordance with the present invention.

The shell 14 constructed in accordance with the present invention is illustrated in FIGS. 2A and 2B, and in an alternate embodiment in FIG. 3. As shown, the shell includes a first element 30 and a second element 32. In the embodiment of FIGS. 2A and 2B, the first and second elements are separate pieces, while in the embodiment of FIG. 3, the shell is formed as a single unit, with the first and second elements interconnected by a hinge 34. As the first and second elements forming the shell 14 are substantially identical in the embodiments of FIGS. 2A, 2B, and 3, only the differences between the embodiments will be discussed further. Where the elements of the FIG. 3 embodiment are identical to the elements of the FIGS. 2A and 2B embodiments, the same reference numerals will be used for identification, but with a prime designation.

As shown in FIGS. 2A, 2B, and 3, the shell first and second elements 30, 32, together define the interior package compartment 24. In the embodiments of FIGS. 2A and 3, the first and second elements each include a sealing surface 33a, 33b, internal surfaces 22*a*, 22*b* forming the internal surface 22, and shelf portions 16*a*, 16*b* forming the shelf 16, respectively. In the embodiment of FIG. 2B, the first and second elements are identical to the embodiments of FIGS. 2A and 3, except that the second element does not include the shelf portion 16*b*. The shelf portions 16*a*, 16*b* are substantially U-shaped or convex in configuration and directed inwardly toward the plant interior. The shelf portions are formed integrally with their respective first and second elements 30, 32. As shown in FIGS. 1–3, the ends 17 of each shelf portion 16*a*, 16*b* are formed in a plane at approximately 45° with respect to the U-shaped cross section of the shelf portions. The ends 17 of each shelf portion 16*a*, 16*b* are thus configured for mating engagement and formation of the continuous shelf 16 surrounding the shell 14, when the first and second elements 30, 32 are in sealed engagement as shown in FIG. 1.

The first shell element 30, 30' has a substantially cylindrical configuration with a spherical top surface 38, a front surface 39, a bottom surface 40, and an opening 42 for mating engagement with the second element 32 intermediate the top and bottom surfaces 38, 40. The sealing surface 33*a* is provided surrounding the opening 42. As illustrated, the top surface 38 of the first element 30 has a spherical configuration.

The bottom surface 40 includes two ramp portions 44 separated by a rib portion 46. The ramp portions are inclined at an angle, as shown in FIGS. 2A, 2B, and 3, to assist with removal of the shell from the mold during manufacture. The rib portion 46 forms an approximately 90° angle with respect to the plane of the second shell element when engaged with the first element. With the rib portion at 90°, the plant package 12 may be readily positioned at eye level on a merchandise shelf for easy viewing of the live plant by consumers. The preferred embodiment of FIGS. 1, 2A, 2B, and 5 additionally includes a platform portion 47. The platform portion provides additional stability and support to the plant package when positioned on a merchandise shelf.

Figure 5:
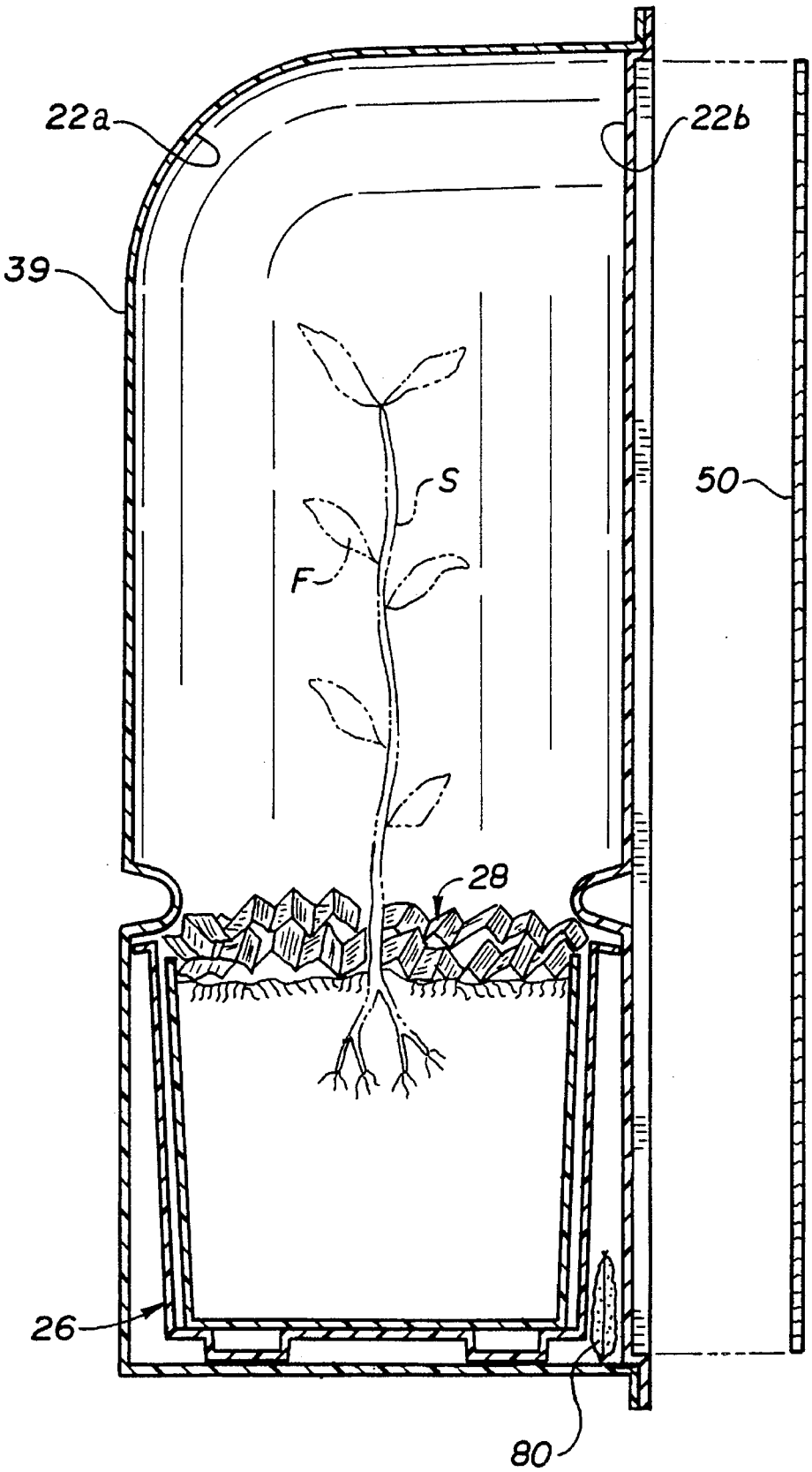
FIG. 5 is a schematic cross-sectional side view of the plant package of FIG. 1 taken along the line 5—5, and showing a panel.
Figure 7:
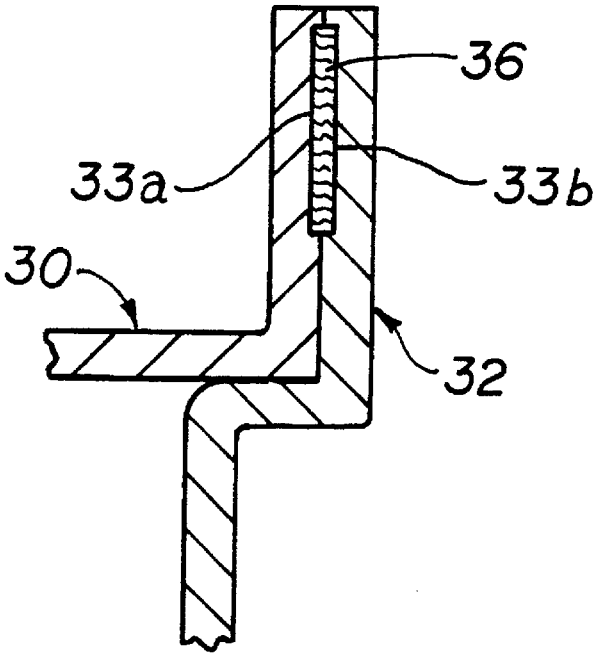
FIG. 7 is a schematic cross-sectional, cut-away view of a seal of a shell of the plant package of the present invention.

The second element 32 is configured for sealed mating engagement within the first element opening 42, and has a substantially flat configuration. The second element is matingly engaged with the first element 30 on an engagement surface 52. It is noted that the opening 42 of the first shell element 30 is of a size slightly smaller than the size of the engagement surface 52 surrounding the second shell element 32. This difference in size provides an interference fit between the first and second shell elements when the engagement surface 52 engages the opening 42. Such a press-fit engagement between these elements serves to strengthen the seal 36 therebetween, and ensure proper sealing of the shell. As best shown in FIG. 5, the second element also includes an insert bed portion 48 for receiving a panel 50 which in the illustrated embodiment provides additional structural support to the shell 14. A bead portion 49 surrounds the insert bed portion, and is on a surface of the second element opposite the engagement surface 52, as shown in FIG. 7. The location of the bead portion 49 enables the panel 50 to be snapped into, and maintained in, engagement within the insert bed portion.

The sealing surface 33*b* of the second element surrounds the insert bed portion adjacent the engagement surface 52, and is configured for aligned engagement with the sealing surface 33*a* of the first element. In a further embodiment of the invention, the panel 50 may additionally be provided with printed advertising or consumer information which may be observed by the consumer through both the first and second transparent elements of the shell.

In one embodiment of the present invention, both the first element 30 and the second element 32 of the shell 14 may be manufactured from a polymer materials, preferably polyethylene terephtlialate glycol ("PETg"), but may also be manufactured of polyvinyl chloride ("PVC") or other coextruded polymer materials. The shell 14 is preferably manufactured by conventional vacuum forming of the polymer material. In particular, manufacture of the first element 30 of the shell is preferably formed using conventional pre-forming or plug-assist vacuum molding techniques which are also well known to those of ordinary skill in the art. Using techniques of this type, portions of the shell may be made in one or more desired thicknesses as may be necessary. Such variation in shell thickness enables the shell to have the desired rigidity for purposes of supporting the plant or other characteristics. Further, the shell is of a material and thickness which is impermeable to bacteria, fungus and insects to prevent such harmful elements from entering the package interior and to prevent loss of water vapor from the package interior.

In the alternate embodiment of the present invention shown in FIG. 2B, the second element 32 of the shell 14 may be manufactured from a cardboard material. In this embodiment, the second element 30 does not include the shelf portion 16*b*. The inner surface of this cardboard material may be coated with a PVC. Such a PVC backed cardboard is sold by Cardpack, Inc. of 19220 Miles Avenue, Cleveland, Ohio 44128. The outer surface of this cardboard material may be non-laminated or partially laminated. In this alternate embodiment, the first element 30 of the shell 14 would still be manufactured from a polymer material as discussed above.

The polymer material of the first shell element 30 is transparent to enable the transmission of light to the foliage of the plant, and to enable consumers to visually observe and inspect the foliage of the live plant prior to sale. However, it should be understood that portions of the shell not containing light dependent foliage of the live plant, need not be transparent.

In the preferred embodiments of the present invention, and as shown in FIG. 5, the overall thickness of the shell 14 is between ½–125 mils, and is sufficient to maintain the self-supporting feature of the shell. However, it should be understood that specific areas of the shell having specific thicknesses to obtain desired features or characteristics may also be used. The range of such thicknesses depends on the features or characteristics desired.

To reduce the effect of fogging within the shell 214, the internal surface 22 of the shell may also be provided with any treatment which would lower the surface tension of the package material, e.g., a surfactant or polymer treatment. Any suitable known surfactant or polymer treatment may be used, including nonionic, anionic and cationic surfactants such as those conventionally available from chemical or other suppliers, or a silicone treatment, respectively. The surfactant or polymer treatment reduces the surface tension of water droplets forming on the internal surface 22 of the shell 14, and thus prevents the formation of large water droplets. The prevention of large water droplets prevents fogging on the inside surface of the container. Such fogging decreases the visibility of the live plant to the consumer, and the amount of light transmitted to the plant. Additionally, the absence of large water droplets prevents the foliage of the plant from being damaged by continual contact with water.

The roots R and rooting medium D surrounding the roots of the live plant are maintained within a container 26, which is housed within the first root compartment 18 of the shell. In the preferred embodiment of the present invention shown in FIGS. 4 and 5, the container 26 includes an inner container 60 for housing the roots R and rooting medium D, and an outer container 62 for maintaining the inner container 60. To provide the live plant with the necessary moisture to survive during the time anticipated for shipment, storage and consumer sale, water may be provided within the containers.

Figure 6A:
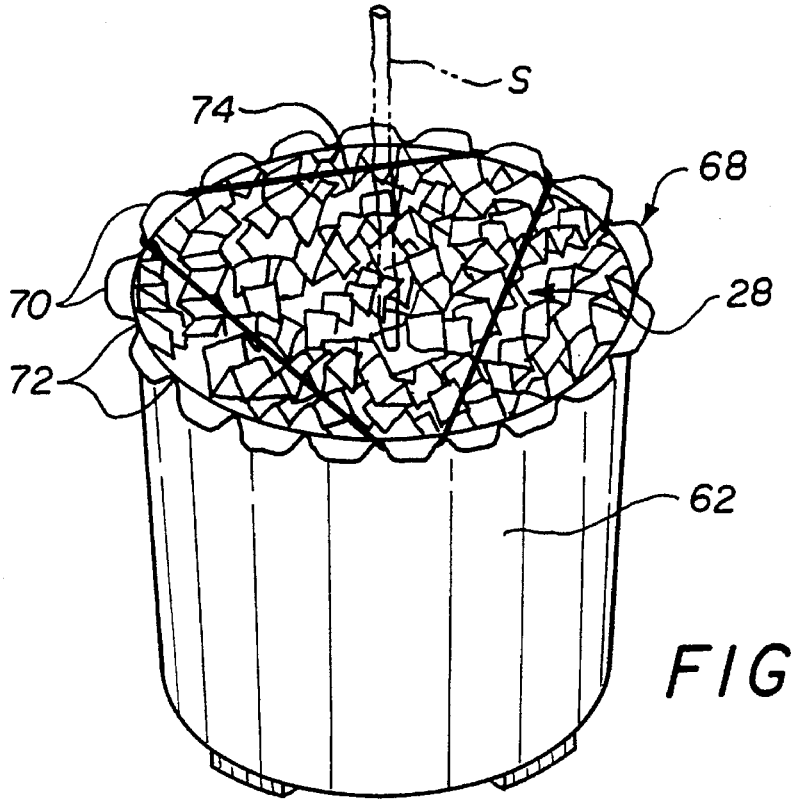
FIGS. 6A and 6B are perspective schematic views of the divider and a band engaged with the outer container.
Figure 6B:
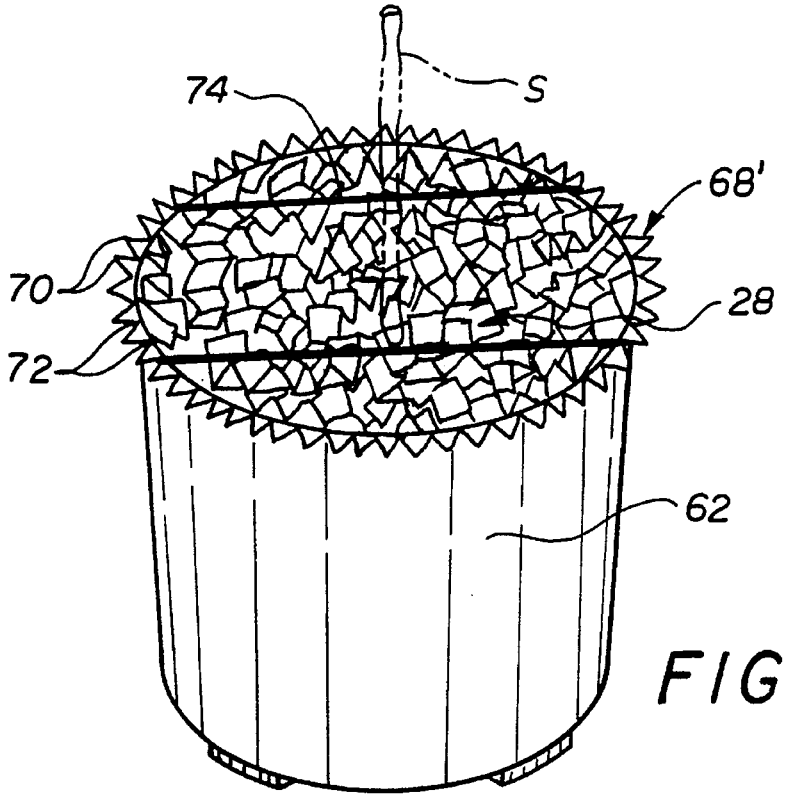

Both the inner and outer containers 60, 62 have top openings 61, 63 for receiving the roots and rooting medium and inner container, respectively. The outer container 62 has feet 64 to raise the container off the internal surface 22. Further, the outer container 62 has a rim 66 which assists with maintenance of the containers 60, 62 in proper position within the first root compartment 18. In one embodiment, the rim 66 has a variable edge 68 with a leaf-like appearance, as shown in FIG. 6A. However, the rim 66 could have any desired edge, such as a jagged or zigzag edge 68' as shown in FIG. 6B The edge 68, 68' defines a plurality of peaks 70 and valleys 72. Additionally, the inner container 60 has a diameter smaller than that of the outer container 62, and the outer container has a diameter larger than the distance A, defined as shown in FIG. 5, between the troughs of the U-shaped shelf 16. These relative diameters are provided to ensure that the container 26 is maintained within the first root compartment 18 of the shell 14 of the plant package 12.

The divider 28 assists with maintenance of the roots and rooting medium within the inner container 60. The divider 28 may comprise a plurality of narrow, elongated, crimped strips of paper material. Such a product is sold by Ranpak Corp. of 8023 Crile Road, Concord Township, Ohio 44077 under the tradenames EcoPak™ and SizzlePak™. Preferably, this paper product will be copper treated to prevent plant disease organisms. The copper treated form of this product is also available from Ranpak Corp. under the same tradenames. Alternatively, the divider 28 may comprise a variety of other materials, such as plastic, non-woven fabrics, or hardening substances. A band 74 or support member of cord, yarn, wire, or line is provided which helps to hold the divider 28 within the containers 60, 62. Preferably, the band 74 is elastic, but may also be non-elastic. As shown in FIGS. 6A and 6B, the band 74 is secured around the rim 66 in such a manner as to help maintain the divider 28, and thus the roots and rooting medium, within the containers 60, 62. Specifically, the band 74 is positioned along two or more chords on the circumference of the rim 66 and passes through the valleys 72 in the edge 68, 68' of the rim. The peaks 70 prevent the band 74 from moving out of this position.

During packaging of the live plant into the plant package 12, the live plant within the inner container 60 or grower's pot is placed within the outer container 62. Before the live plant is provided within the first element of the shell, any desired surfactant or nutrient materials are provided on the internal surface 22*a* of the first element 30. It should be understood, as set forth in U.S. Pat. No. 4,118,890, that certain surfactant materials may be added to the polymer material during the manufacture of the material or its formation. Additionally, any necessary nutrients or moisture may be provided to the container 26 or rooting medium D at this time.

Figure 4:
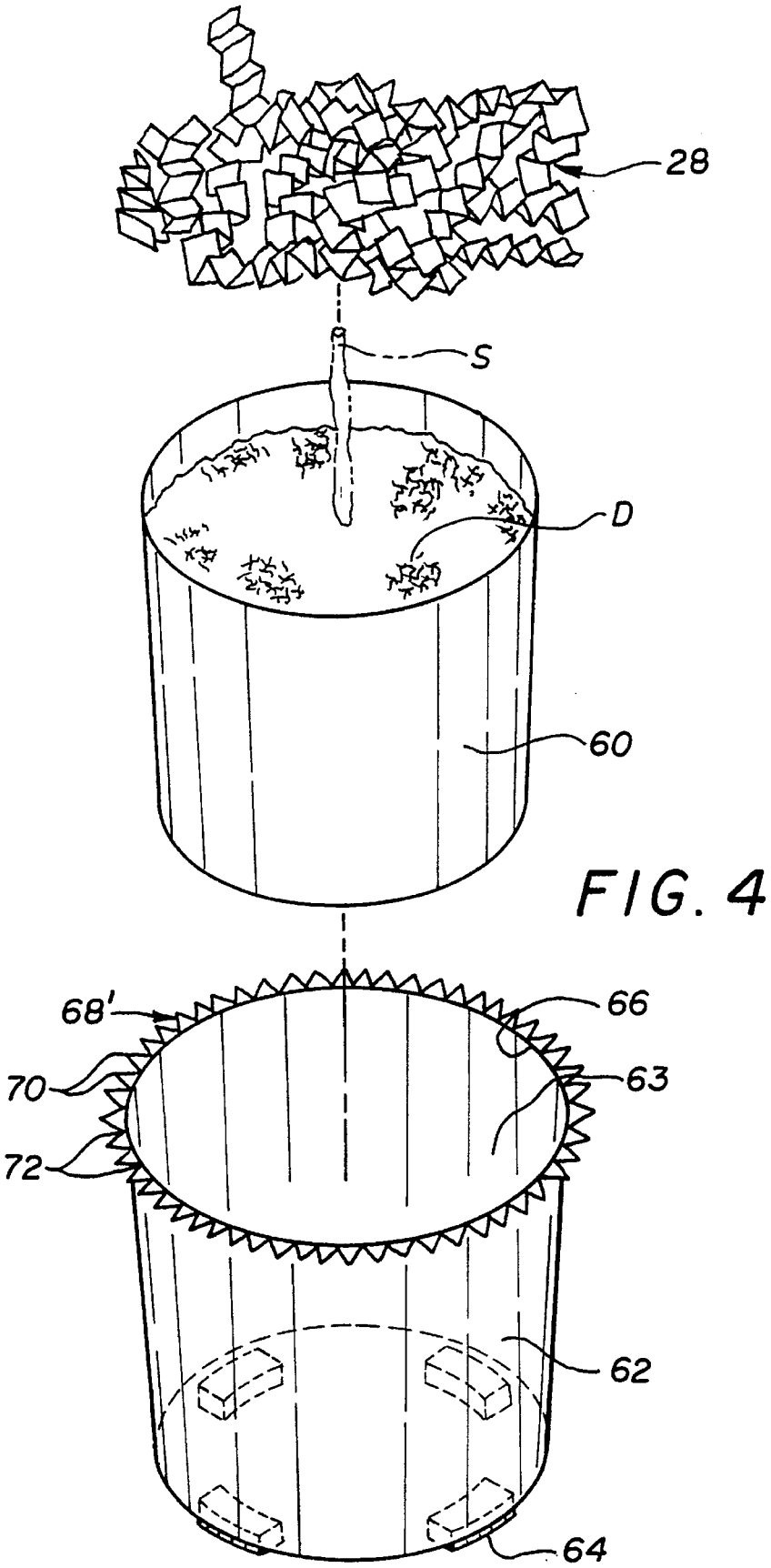
FIG. 4 is a perspective schematic view of an inner and outer container and a divider of a plant package constructed in accordance with the present invention.

The divider 28 is then positioned such that the strips of paper material surround the stem S, and the divider covers the rooting medium D and the top openings 61, 63 of the containers 60, 62, in the order shown in FIG. 4. Once this process is completed, the container 26 is placed on the internal surface 22*a* of the first root compartment 18 of the first element 30 of the shell 14. In this position, the edges 68 of the rim 66 are engaged with the shelf 16*a*.

Engagement of the edges 68 of the rim 66 with this portion of the shelf maintains the containers 60, 62 in proper position within the first root compartment 18. Further, the divider 28 and the band 74 together form a cushioning and absorption membrane which secures and maintains the roots and rooting medium within the inner container 60 in the first root compartment 18. In the event it is desired to add any elements or compounds to the first element 30 of the shell 14 before it is sealed, those elements or compounds are now added.

Figure 8:
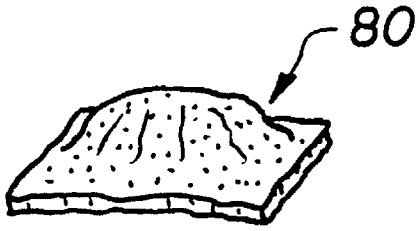
FIG. 8 is a perspective schematic view of a packet containing ethylene scrubbers.

For example, it may be desired to add ethylene scrubbers to the first element 30 of the shell 14 between the outer container 62 and the internal surface 22. Some plants, in particular flowering plants, produce ethylene gas. Ethylene gas in turn causes the leaves of the plants to drop. Therefore, with those plants which produce ethylene, it is desirable to remove the ethylene gas which is produced from the atmosphere within the plant package. The removal of ethylene gas is accomplished by the ethylene scrubbers. The ethylene scrubbers comprise calcined clay prills formed from clay particles which have been coated with an ethylene scrubbing compound. Each prill has a diameter of approximately two millimeters. Such ethylene scrubbers are sold by Ethylene Control of Portland, Oreg. The ethylene scrubbers are sealed in a packet 80 which may be formed from Kraft paper, as shown in FIG. 8. In the preferred embodiment of the present invention, 9 grams of ethylene scrubbers are placed in the plant package 12.

The insert bed portion 48 of the second shell element 32 is then engaged within the opening 42 of the first shell element along the engagement surface 52. In the embodiment of the shell shown in FIGS. 2A and 2B, the first and second elements 30, 32 are simply engaged together. In the embodiment of the shell shown in FIG. 3, the hinged elements 30', 32' are moved into engagement in the direction of the illustrated arrows. With the engagement of the first and second elements, the continuous shelf 16 is formed and the separation between the compartments 18, 20 provided by the divider 28 is accomplished.

The seal 36 shown in FIG. 7 is then provided between the sealing surfaces 33*a*, 33*b* of the first and second elements of the shell 14. In the embodiment of the invention shown in FIG. 2B, the seal used would be in the form of conventional blister packaging. The seal 36 is preferably provided by heat, but may be provided by glue or other physical means which prevent the passage of water vapor, insects, fungus or bacteria from passing through the seal and shell. Once the seal 36 is in place, the divider 28 and shelf 16 provide a barrier which, despite movement of the plant package out of the upright position, prevents the container 26 from moving out of position within the root compartment 18 and protects the plant foliage F.

While a preferred embodiment of the invention has been disclosed in detail, along with certain alternative constructions and arrangements, the present invention is not to be considered limited to the precise constructions disclosed herein. Various adaptations, modifications and uses of the invention may occur to those skilled in the art to which the invention relates, and the invention is to cover all such adaptations, modifications and uses falling within the spirit and scope of the following claims.

We claim:

1. A plant package for a live plant having a stem, roots and rooting medium surrounding the roots, comprising:

a self-supporting, light transmissive, sealed shell having an internal surface defining a package interior, and a shelf on said internal surface, said shell shelf defining first and second interior compartments of said shell for containing said roots and stem, respectively, a container for said roots and rooting medium surrounding said roots, engaged within said first interior compartment, and a divider surrounding said stem, partially engaging said rooting medium, and forming a cushioning barrier intermediate said first and second interior compartments, wherein said divider includes a cushioning membrane for compression and supporting form fitting engagement with said container, and a support member engaged with said shelf for reducing the passage of material and water vapor between said first and second interior compartments, wherein said container comprises an inner container for said roots and rooting medium surrounding said roots, and an outer container engaged with said internal surface of said first interior compartment, for containing said inner container, and wherein said outer container includes an edge portion extending outwardly from said outer container and having peaks and valleys formed therein.

2. The plant package of claim 1, further including a support member for engagement with said divider edge portion and said cushioning membrane for securing said cushioning membrane within said outer container and conforming said cushioning membrane to surround said live plant stem.

3. The plant package of claim 2, wherein said shell is of a polymer material wherein a portion of said shell defining said first interior compartment has a thickness substantially impermeable to water vapor, and for supporting said container.

4. The plant package of claim 3, wherein said cushioning membrane comprises paper.

5. The plant package of claim 4, wherein said sealed shell contains an ethylene scrubber.

6. The plant package of claim 5, wherein said first and second shell elements are sealed together surrounding said opening in said first element.

7. The plant package of claim 6, wherein said support member comprises a continuous band secured within said valleys of said edge portion across said outer container.

8. A plant package for a live plant having a stem, roots and rooting medium surrounding the roots, comprising:

a self-supporting, light transmissive, sealed shell having an internal surface defining a package interior, and a shelf on said internal surface, said shell shelf defining first and second interior compartments of said shell for containing said roots and stem, respectively, a container for said roots and rooting medium surrounding said roots, engaged within said first interior compartment, and a divider surrounding said stem, partially engaging said rooting medium, and forming a cushioning barrier intermediate said first and second interior compartments, wherein said shell comprises first and second elements, each of said elements having an internal surface forming a portion of said package interior, and including a portion of said shelf, wherein said divider includes a cushioning membrane for compression and supporting form fitting engagement with said container, and a support member engaged with said shelf for reducing the passage of material and water vapor between said first and second interior compartments, wherein said container comprises an inner container for said roots and rooting medium surrounding said roots, and an outer container engaged with said internal surface of said first interior compartment, for containing said inner container, and wherein said outer container includes an edge portion extending outwardly from said outer container and having peaks and valleys formed therein.

9. The plant package of claim 8, further including a support member for engagement with said divider edge portion and said cushioning membrane for securing said cushioning membrane within said outer container and conforming said cushioning membrane to surround said live plant stem.

10. The plant package of claim 9, wherein said shell is of a polymer material wherein a portion of said shell defining said first interior compartment has a thickness substantially impermeable to water vapor, and for supporting said container.

11. The plant package of claim 10, wherein said cushioning membrane comprises paper.

12. The plant package of claim 11, wherein said sealed shell contains an ethylene scrubber.

13. The plant package of claim 12, wherein said first and second shell elements are sealed together surrounding said opening in said first element.

14. The plant package of claim 13, wherein said support member comprises a continuous band secured within said valleys of said edge portion across said outer container.

15. A plant package for a live plant having a stem, roots, and rooting medium surrounding the roots, comprising:

a self-supporting, light transmissive shell having an internal surface defining a package interior and a shelf on said internal surface, said shell shelf defining first and second interior compartments of said shell for containing said roots and stem, respectively, a container for said roots and rooting medium surrounding said roots, said container having a top opening for receiving said roots and rooting medium and a rim engaging said shell shelf for maintaining said container within said first interior compartment, and a divider surrounding said stem, at least partially covering said rooting medium, and forming a cushioning barrier intermediate said first and second interior compartments, said divider including a cushioning membrane and a support member engaged with said container and said cushioning membrane for maintaining said cushioning membrane within said container top opening, thereby reducing the passage of material between said first and second interior compartments.

16. The plant package of claim 15, wherein said support member is engaged with said container rim.

17. The plant package of claim 16, wherein said container rim has an edge for securing engagement with said support member.

18. The plant package of claim 17, wherein said support member comprises a continuous band engaged with said edge of said container rim.

19. The plant package of claim 17, wherein said edge has a plurality of peaks and valleys.

20. The plant package of claim 19, wherein said edge is a leaf-like edge.

21. The plant package of claim 19, wherein said edge is a jagged edge.

22. The plant package of claim 15, wherein said cushioning membrane comprises paper.

23. The plant package of claim 15, wherein said shell comprises first and second elements, each of said elements having an internal surface forming a portion of said package interior and a shelf.

24. The plant package of claim 23, wherein said first and second shell elements are sealed together.

25. The plant package of claim 15, wherein said container comprises an inner container for said roots and rooting medium surrounding said roots and an outer container for said inner container, said outer container engaging said shell shelf for maintaining said outer container within said first interior compartment.

26. The plant package of claim 25, wherein said outer container has a rim for engaging said shell shelf.

27. The plant package of claim 15, wherein said shell is of a polymer material and wherein a portion of said shell defining said first interior compartment has a thickness substantially impermeable to water vapor and capable of supporting said container.

28. The plant package of claim 15, wherein said shell contains an ethylene scrubber.

* * * * *